United States Patent [19]

Ueno et al.

[11] 4,021,196

[45] May 3, 1977

[54] PROCESS FOR PRINTING FIBER PRODUCTS OF ACRYLIC FIBER BLENDS

[75] Inventors: Eichiro Ueno, Wakayama; Hideo Kawasaki, Moriyama; Shozo Shigita, Hirakata, all of Japan

[73] Assignee: American Cyanamid Company, Stamford, Conn.

[22] Filed: Dec. 13, 1973

[21] Appl. No.: 424,410

[52] U.S. Cl. ..... 8/21 A; 8/28; 8/37

[51] Int. Cl.[2] ..... D06P 3/82

[58] Field of Search ..... 8/21 A

[56] References Cited

UNITED STATES PATENTS

| | | | |
|---|---|---|---|
| 2,922,690 | 1/1960 | Mueller et al. | 8/21 A |
| 3,211,514 | 10/1965 | Casty et al. | 8/21 A X |
| 3,708,258 | 1/1973 | vonderEltz et al. | 8/21 A |
| 3,843,319 | 10/1974 | vonderEltz et al. | 8/21 A |

FOREIGN PATENTS OR APPLICATIONS

| | | | |
|---|---|---|---|
| 444,615 | 2/1969 | Japan | 8/21 A X |

*Primary Examiner*—William F. Hamrock
*Attorney, Agent, or Firm*—William J. van Loo

[57] ABSTRACT

Fiber products of a blend of an acrylic fiber substantially free of acid dye sites with an acid dyeable fiber are printed with a dye paste containing a monosulfonic acid dye having an inorganicity/organicity ratio less than 4 to dye both fibers of the blend uniformly. As an alternative an additional acid dye outside the specific class designated may be used to augment the dyeing of the acid dyeable fiber.

10 Claims, No Drawings

PROCESS FOR PRINTING FIBER PRODUCTS OF ACRYLIC FIBER BLENDS

This invention relates to a process for printing acrylic fiber which have no acid dye sites in blend with fibers having acid dye sites with one or more acid dyes. More particularly, the invention relates to such a process wherein a special acid dye class is used alone or in conjunction with acid dyes of other classes.

In accordance with conventional procedures, when a fiber assembly containing a blend of conventional acrylic fibers having no sites for acid dyes with fibers that are acid dyeable is considered for dyeing, it is usual practice to dye the acrylic fibers with cationic dyes and the acid-dyeable fibers with acid dyes, which is in conformity with the dyeing characteristics of the fibers involved. However, when dyes of different ionic character, i.e. cationic dyes and anionic dyes, are present in the same dyeing medium, they will form a complex and precipitate. Use of such a medium will give rise to uneven dyeing of the fiber assembly being dyed and makes it impossible to achieve the specific color desired. In addition, difficulties arise with respect to dye loss, soiling of the dyeing equipment, spotty dyeings, and the like. For this reason, when dyeing with a medium containing dyes of opposing ionic charges, it is necessary to add various anti-precipitants thereto.

However, in cases where printing of such a fiber assemblage is contemplated, the situation is considerably different. In printing, the paste containing the dyes is highly concentrated whereas in dyeing, the medium is exceedlingly dilute. In printing using dyes of different ionic charges, specks (deeply colored areas) occur due to dye precipitation and the printing paste is unstable, and thus causes numerous problems. Because of the concentrated nature of the printing paste, it is not possible to correct these problems by the use of the conventional anti-precipitants used in conjunction with dyeing media. Accordingly, in printing such blends, recourse has been had to the use of printing pastes in which ionic dyes are not present. The printing pastes normally employed with such blends contain pigments, with full awareness of the deficient properties of such colorants, e.g. low fastness to crocking, harsh feel of the printed fiber assembly, limited color values, and the like.

In accordance with the present invention, there is provided a process for dyeing a product of a fiber blend of from about 25 to 75 weight percent of an acrylic fiber substantially free of acid dye sites, and correspondingly, from about 75 to 25 weight percent of an acid dyeable fiber, which process comprises printing said fiber product with a printing paste containing a monosulfonic acid dye having an inorganicity/organicity ratio less than 4 and thereafter steaming the printed fiber product, whereby both components are dyed with said dye. In a distinctive embodiment of the invention, the printing paste contains an acid dye with more than one sulfonic acid group, an inorganicity/organicity ratio greater than 4, or both in addition to the monosulfonic acid dye of inorganicity/organicity ratio of less than 4 whereby the acrylic fiber substantially free of acid dye sites is dyed with said monosulfonic acid dye of inorganicity/organicity ratio of less than 4 and the acid dyeable fiber is dyed with both dyes.

Thus, in accordance with the present invention, the dye that is effective on the two fibers of different dyeing characeristics is the same dye or a mixture of dyes of the same ionic type. As a result, all of the problems associated with previous dye mixtures are avoided and recourse does not have to be made to pigments with their attendant problems. The present process enables the different fiber types to be dyed the same shade or in different shades which may vary from different hues to distinct colors.

Although the exact mechansim by which the specific acid dyes dye the acrylic fibers which are substantially free from acid dye sites is not known and applicants do not wish to be bound by any theory, it is possible that the specific acid dyes are present in these fibers much like disperse type dyes are distributed and no inonic bonds are involved.

As used in the present specification, the expression "acrylic fiber substantially free of acid dye sites" is intended to mean fibers obtained from acrylonitrile polymers having no basic groups. Two or more such polymers may be employed in fiber-making. Such polymers generally will contain at least 40 weight percent acrylonitrile. Typical polymers are those which contain acid groups such as sulfonic acid groups, carboxylic acid groups, and the like. Specific fibers are those including monocomponent and composite fibers of the types designated as acrylic and modacrylic fibers. Typical commercial products have the registered trademarks: Orlon, Dynel, Acrilan, Creslan, Exlan, and the like.

The expression "acid dyeable fibers" as that term is used in the present specification and claims is intended to mean animal fibers such as wool, cashmere, silk, etc., and synthetic fibers such as nylon, acrylic, or polyester fibers having basic groups therein which are receptive to acid dyes.

The fiber products may be woven or knit fabrics, non-woven fabrics, carpets, and the like that are produced from blends of the fibers specified. The blends may be achieved by spinning a blend of mixed fibers into yarn, by twisting yarns of the individual fibers into yarn blends or by introducing yarns of individual fibers into the weaving or knitting patterns, etc.

As the effective dye to color the acrylic fiber substantially free of acid dye sites, it is necessary to employ a monosulfonic acid dye which has an inorganicity/organicity ratio of less than 4, as described in "The Kagaku-no-Ryoiki", vol. 11, No. 10, pages 719-725 (1957). The sulfonic acid group may be in the form of the free acid or as a salt of a monovalent cation. If an acid dye as defined is not employed, it is not possible to dye the acrylic fiber substantially free of acid dye sites. It is, of course understood that this dye will also dye the acid dyeable fiber.

The method of calculating the ratio of inorganicity to organicity is illustrated by the following, using CI Acid Orange 7 as an example.

C.I. Acid Orange 7 = 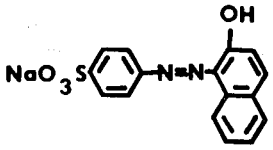

Organicity = Number of Carbon atoms × 20 = 16 × 20 = 320

| | | | |
|---|---|---|---|
| Inorganicity = | $-SO_3Na$ = 250 + 500 | = | 750 |
| | —OH = 100 | = | 100 |
| | Naphthalene nucleus | = | 60 |
| | —N=N— | = | 30 |

-continued

| | | |
|---|---|---|
| Benzene nucleus | = | 10 |
| Total | | 950 |

Ratio of Inorganicity/Organicity (I/O) = 950/320 = 2.97

When an acid dye of the specified sulfonic acid content and I/O ratio is used alone in the printing paste it will dye both fiber components equally. However, when an acid dye not having the specified sulfonic acid content, I/O ratio, or both is used with the specified dye, the acid dyeable fiber can be dyed in a deeper shade or different shade. The other acid dyes, for example, may be a disulfonic or trisulfonic dye or a metallized acid dye.

In preparing the printing paste for the present use, any conventional printing paste material may be employed. Such agents as sodium alginate, starch, processed starches, semi-synthetic cellulosic materials, such as carboxymethylcellulose, crystal gum, locust bean gum or modified products thereof, and the like may be used. Conventional paste auxilaries such as urea may also be used in conformity with conventional use.

The fiber product is printed with the printing paste containing the useful dye or dyes in accordance with conventional procedures and then subjected to steaming to fix the dye to the fibers. Desirably, such steaming is carried out at temperatures above 100°C. and preferably above 105°C. for at least about 5 minutes. To promote the effect of the steaming treatment, it is desirable to add to the printing paste about 1 to 10 weight percent of a solvent for the acrylic fiber, for example ethylene carbonate, dimethyl formamide, thiocyanate salt solutions, and the like, the solvent percentages being based on the weight of printing paste.

After the fiber product has been subjected to steaming, it is washed, rinsed, dried, etc. to provide the finished product.

The invention is more fully illustrated by the examples which follow wherein all parts and percentages are by weight unless otherwise specified.

EXAMPLE I

A knit fabric produced from a blended yarn consisting of 50 percent of an acrylic fiber substantially free of acid dye sites and 50 percent of wool was printed on a screen printing machine using a printing paste consisting of 2 parts of C.I. Acid Yellow 49, a monosulfonic acid dye of I/O ration = 2.8, 2 parts of thiodiethylene glycol, 60 parts of an 11% aqueous solution of a commercial paste forming agent identified by the trademark Indalca ABV and 36 parts of water. The fabric was then steamed at 110°C. for 30 minutes and thereafter washed, rinsed, and dried in conventional manner.

The knit fabric obtained had a clear and level yellow color on both fiber types, showing no specks. The dyeing exhibited good color fastness and good resistance to crocking.

COMPARATIVE EXAMPLE A

Following the procedure of Example 1 in all details a print was made using instead of the dye of Example 1 a dye of the following structure.

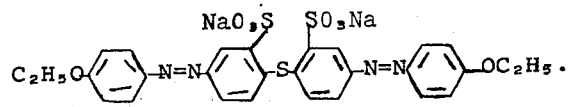

The wool fiber content of the knit blend fabric assumed a good yellow color but the acrylic fiber content remained substantially undyed, thus yielding an unsatisfactory product. The dye contained two sulfonic acid groups.

EXAMPLES 2–5

Following the procedure of Example 1 in every material detail, a series of printings were made substituting in each case a dye differing from that of Example 1. In each instance both the wool and acrylic fibers were dyed to the same color and a desirable fiber product was obtained. The dyes employed in the various examples are listed below with specific I/O ratios, all being monosulfonic acid dyes.

Example 2 = C.I. Acid Red 9, I/O = 2.5
Example 3 = C.I. Acid Blue 62, I/O = 2.8
Example 4 = C.I. Acid Blue 40 I/O = 3.0
Example 5 = C.I. Acid Orange 7, I/O = 3.0

EXAMPLE 6

A blend-woven fabric produced from spun yarn consisting of acrylic fiber containing only sulfonic acid groups as dye sites and nylon filament yarn, relative yarn portions about 50/50, was printed with a printing paste consisting of one part of a monosulfonic acid red dye of the structure

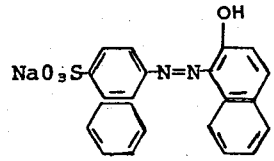

I/O = 2.5

2 parts of thiodiethylene glycol, 60 parts of an 11% aqueous solution of the paste forming agent of Example 1 and 37 parts of water.

The printed fabric was steamed at 110°C. for 15 minutes and then washed, rinsed, and dried.

The fabric obtained assumed a level red color on both fiber components, thus providing an excellent printed fabric. The dyeing had good color fastness and good resistance to crocking.

COMPARATIVE EXAMPLE B

The procedure of Example 6 except that the dye employed was a trisulfonic acid dye of I/O ratio 6.3 and has the following structure

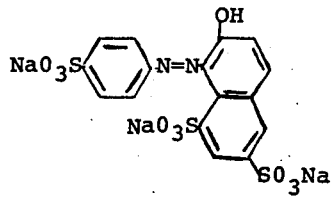

The acrylic fiber remained substantilly undyed and the fabric was unsatisfactory in print content.

EXAMPLE 7

A single knit fabric produced from a blend-twisted yarn consisting of equal parts of an acrylic fiber containing no basic groups and wool was printed with a printing paste consisting of 2 parts of monosulfonic acid blue dye of the formula

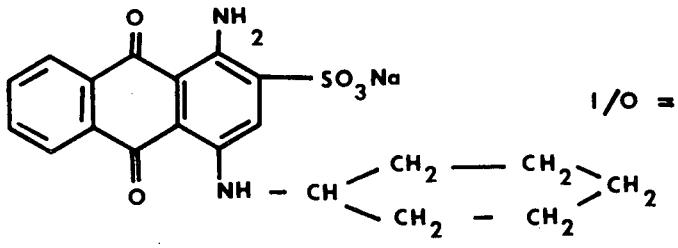

I/O = 2.7

2 parts of thiodiethylene glycol, 60 parts of an 11% aqueous solution of the paste forming agent of Example 1, 4 parts of ethylene carbonate, and 32 parts of water. The printed fabric was steamed at 115° C. for 20 minutes and then washed, rinsed, and dried.

The fabric obtained was excellent in dyeing uniformity of both fiber types and had an excellent feel.

EXAMPLE 8

A knit fabric of rib stiches produced from a blended yarn consisting of 30 parts of acrylic fiber containing no acid dye sites and 70 parts of wool was printed with a dye paste consisting of 1.5 parts of monsulfonic dye identified as C.I. Acid Yellow 49 of I/O ratio 2.8, 0.5 part of a trisulfonic acid dye identified as C.I. Acid Blue 92, 2 parts thiodiethylene glycol, 60 parts of an 11% aqueous solution of the paste forming agent of Example 1 and 36 parts of water. The printed fabric was steamed at 120°C. for 15 minutes and then washed, rinsed, and dried.

The fabric obtained had its acrylic fiber dyed in yellow color of the monosulfonic acid dye and the wool was dyed in a green color from the mixture of monosulfonic acid dye and the trisulfonic acid dye. The printed article had an excellent esthetic appeal of mixed tone.

We claim:

1. A process for dyeing a product of a fiber blend of from about 25 to 75 weight percent of an acrylic fiber substantially free of acid dye sites and, correspondingly from about 75 to 25 weight percent of an acid dyeable fiber, which process comprises printing said fiber product with a printing paste containing a monosulfonic acid dye having an inorganicity/organicity ratio less than 4 and thereafter steaming the printed fiber product, whereby both components are dyed with said dye.

2. The process of claim 1 wherein said dye paste contains as an additional dye one containing more than one sulfonic acid group, an inorganicity/organicity ratio greater than 4 or both, whereby said additional dye dyes the acid dyeable fiber.

3. The process of claim 1 wherein an acrylic fiber solvent is incorporated in said dye paste to the extent of 1 to 10 weight percent based on the weight of the dye paste.

4. The process of claim 1 wherein steaming is carried out at a temperature of at least 100°C. for at least 5 minutes.

5. The process of claim 4 wherein said temperature is at least 105°C.

6. The process of claim 1 wherein the fiber blend is of acrylic fibers substantially free of acid dye sites and wool.

7. The process of claim 1 wherein the fiber blend is of acrylic fibers substantially free of acid dye sites and nylon.

8. The process of claim 1 wherein the product is a knit fabric.

9. The process of claim 1 wherein the product is a woven fabric.

10. The process of claim 3 wherein the acrylic fiber solvent is ethylene carbonate.

* * * * *